US006427397B1

(12) United States Patent
Kolaschnik

(10) Patent No.: US 6,427,397 B1
(45) Date of Patent: Aug. 6, 2002

(54) FRAME CLADDING FOR THE THERMAL INSULATION OF WINDOWS

(76) Inventor: Achim Klaus Kolaschnik, Kepplerstrasse 2-4, D-30853, Langenhagen (DE)

( * ) Notice: Subject to any disclaimer, the term of this patent is extended or adjusted under 35 U.S.C. 154(b) by 0 days.

(21) Appl. No.: 09/674,901

(22) PCT Filed: Apr. 28, 1999

(86) PCT No.: PCT/DE99/01266

§ 371 (c)(1),
(2), (4) Date: Dec. 29, 2000

(87) PCT Pub. No.: WO99/58801

PCT Pub. Date: Nov. 18, 1999

(51) Int. Cl.[7] ..... E06B 3/00

(52) U.S. Cl. ..... 52/204.5; 52/204.1; 52/210; 52/204.55; 52/211; 52/204.53; 52/204.54; 52/209

(58) Field of Search ..... 52/204.5, 204.1, 52/210, 204.55, 211, 204.53, 204.54, 209

(56) References Cited

U.S. PATENT DOCUMENTS 4,443,974 A * 4/1984 Schulthess ..... 52/212
5,890,331 A * 4/1999 Hope ..... 52/209
6,098,355 A * 8/2000 Li ..... 52/212
6,202,353 B1 * 3/2001 Giacomelli ..... 52/204.1

FOREIGN PATENT DOCUMENTS

DE 25 18 800 * 4/1975

* cited by examiner

*Primary Examiner*—Carl D. Friedman
*Assistant Examiner*—Chi Q. Nguyen
(74) *Attorney, Agent, or Firm*—Flanagan & Flanagan; John R. Flanagan

(57) ABSTRACT

The invention concerns an arrangement for improving the thermal insulation of windows in which the outer face of the window frame (1) is provided with a casing (5) of weatherproof material which forms a cavity (17) and has the side of the casing not adjacent the masonry (8) turned inward toward the pane of glass (3) where it is fitted with a permanently elastic gasket (10) which makes contact with the glass. The cavity is filled completely with thermal insulation material. Using the arrangement according to the invention allows a thermal transmittance value for the complete window ($U_w$-value) of less than 1 to be achieved.

12 Claims, 2 Drawing Sheets

FRAME CLADDING FOR THE THERMAL INSULATION OF WINDOWS

BACKGROUND OF THE INVENTION

The invention concerns a frame cladding for the thermal insulation of windows having a window frame in a masonry opening and a sash frame incorporating a window pane of insulating glass.

The increasingly rigorous requirements regarding the insulating performance of windows and which have to be fulfilled according to the current or anticipated statutory regulations are met by glazing but not by the materials of frame material group 1 (wood/plastic) generally used for single windows.

The best insulating glazing already achieves a thermal transmittance value (U-value) of 0.4 $Wm^2K$, while wood or plastic can only achieve a U-value of 1.3 $Wm^2K$. A new Thermal Insulation Act due to come into force shortly will call for a $U_w$-value of 1 for the complete window, which is not feasible with the technology used hitherto.

SUMMARY OF THE INVENTION

A facade element with a window opening is known from DE-A-25 18 800. This facade element has an inner and an outer skin of sheet metal with insulation material filling the cavity between these two skins. This applies not only to the area of the window opening but indeed to the whole facade element. A step is formed in the area of the window opening which is an integral part of the facade element. This step extends over the sash frame of the window and runs parallel to this and the plane of the pane of glass. A permanently elastic gasket, whose lips make contact with the pane of glass, is attached to the end of this step. When the facade element is used as an external cladding and insulating component, then it is fixed directly to a wall. In this case the facade element is designed with a constant thickness without a step in the area of the window opening.

It is the object of the invention to devise a frame cladding for improving the thermal insulation of windows.

This task is solved with the aforementioned frame cladding in that the frame cladding consists of a twin-walled casing made from weatherproof material, whereby the cavity formed between the inner and outer walls is filled with a thermal insulation material, said casing covers the outside of the window frame and sash frame, and at the end of the casing not adjacent the masonry the rainwater drip of the sash frame is bent inwards to overlap the window pane and make contact with said window pane via a permanently elastic gasket fitted to its end.

The arrangement according to the invention covers the edge seal of the insulating glass pane so critical in terms of thermal insulation, and in conjunction with the thermal insulation material enables a $U_w$-value less than 1 to be easily achieved.

An advantageous arrangement of the invention for a window frame of plastic or metal is to form the frame cladding in one piece with this.

In another embodiment form of the invention, the frame cladding is attached as a separate component to the window frame. Such an arrangement is preferable for use with wooden window frames.

In the embodiment of the invention the permanently elastic gasket is detachable and is inserted into the end of the bent part of the casing, e.g. clipped in with a profile.

Advantageous further forms of the invention result from the remaining, related claims.

A window frame is known from DE-OS 26 21 365 in which the outer face of the window frame is provided with a casing of weatherproof material, the end of which incorporates a permanently elastic gasket which makes contact with the pane of glass. This is intended to improve the sealing of the window but, unlike the invention, not the thermal insulation of the window.

BRIEF DESCRIPTION OF THE DRAWINGS

The invention is explained in more detail in the following description of the embodiment examples with reference to the drawings in which.

DETAILED DESCRIPTION OF THE INVENTION

Figure 1:
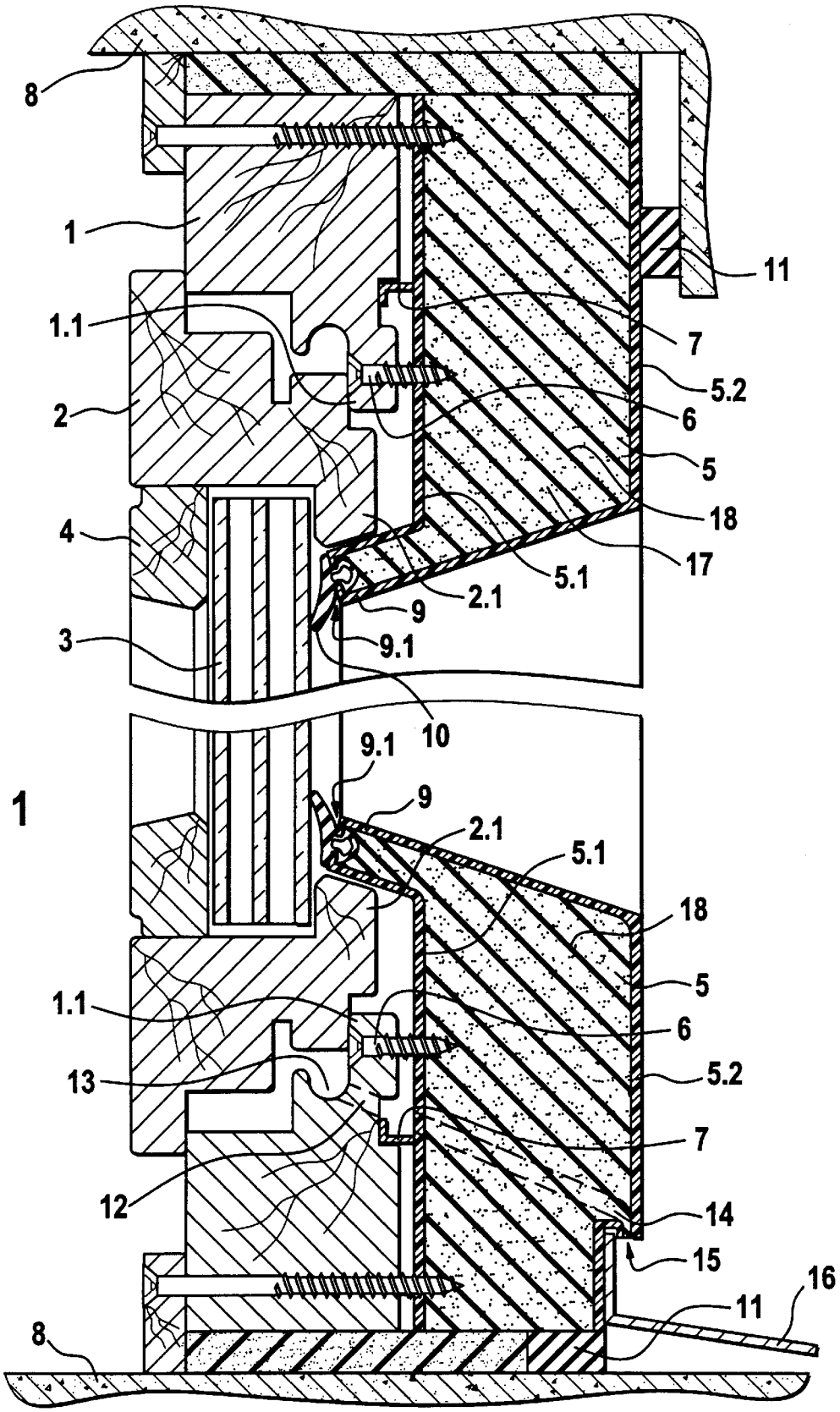
FIG. 1 is a vertical sectional view taken through window and sash frames of a wooden window provided with a separate casing according to the invention.

FIG. 1 shows a section through a wooden window consisting of a window frame 1 encompassing a central cavity and a sash frame 2 encompassing a central region into which central cavity and central region a pane of triple glazing 3 is fixed by means of a glazing bead 4 to the sash frame 2. Attached to the outer face of the window frame 1 is a twin-walled casing 5 of weatherproof material, e.g. PVC or aluminum, having spaced apart inner and outer walls 5.1, 5.2. The casing 5 forms a cavity 17 and is held in place, for example, by means of screws 6 screwed from an inner face 1.1 of the window frame 1 into the inner wall 5.1 of the casing 5. Spacers 7 on the inner wall 5.1 of the casing 5 ensure that there is a gap between casing 5 and window frame 1 such that the inner wall 5.1 of the casing 5 is disposed outside of the central cavity and central region of the respective window frame 1 and sash frame 2. On an inner side of the casing 5 not adjacent to the masonry 8 there is an inner section 9bent from the inner and outer walls 5.1, 5.2 and extending beyond the inner and outer walls into both the central cavity and central region toward the glass pane 3. An unattached end 9.1 of inner section 9 is provided with a permanently elastic gasket 10, one end of which is detachably clipped into the end 9.1 of the inner section 9 and the other end of which makes contact with the glass pane 3 in such a way that the transition between window frame 1 and glass pane 3 is covered by the casing 5 with the permanently elastic gasket 10. The twin-walled casing 5 contains an insulation material 18, such as a polyurethane foam, which by selecting the thermal conductance group 25 and a thickness of 60 mm leads to a U-value for the casing 5 of 0.5 $Wm^2K$. Changing the thickness of the insulation material 18, the type or the thermal conductance group allows the U-value to be adapted to the particular requirement The window frame 1 and the casing 5 are connected to the masonry 8 at top and bottom in a conventional manner using polyurethane foam and mechanical fixings. A compressed sealing strip 11 on the outer face of the casing 5 and on the wall or windows sill ensures an adequate seal.

At the bottom the window frame 1 is provide with through-holes 12 which extend from a drainage channel 13 in the window frame 1 to the gap between window frame 1 and casing 5 and then continue through the holes 14 in the casing 5 to a drip 15 in the casing 5 from where moisture is carried away via the window sill 16. In this section the spacer 7 acts as a collecting channel from where the water drains through the holes 14 to the outside.

The parts of the casing 5 are provided with mitered ends and joined to form a frame. They are subsequently screwed to the window frame 1 from the inside.

Figure 2:
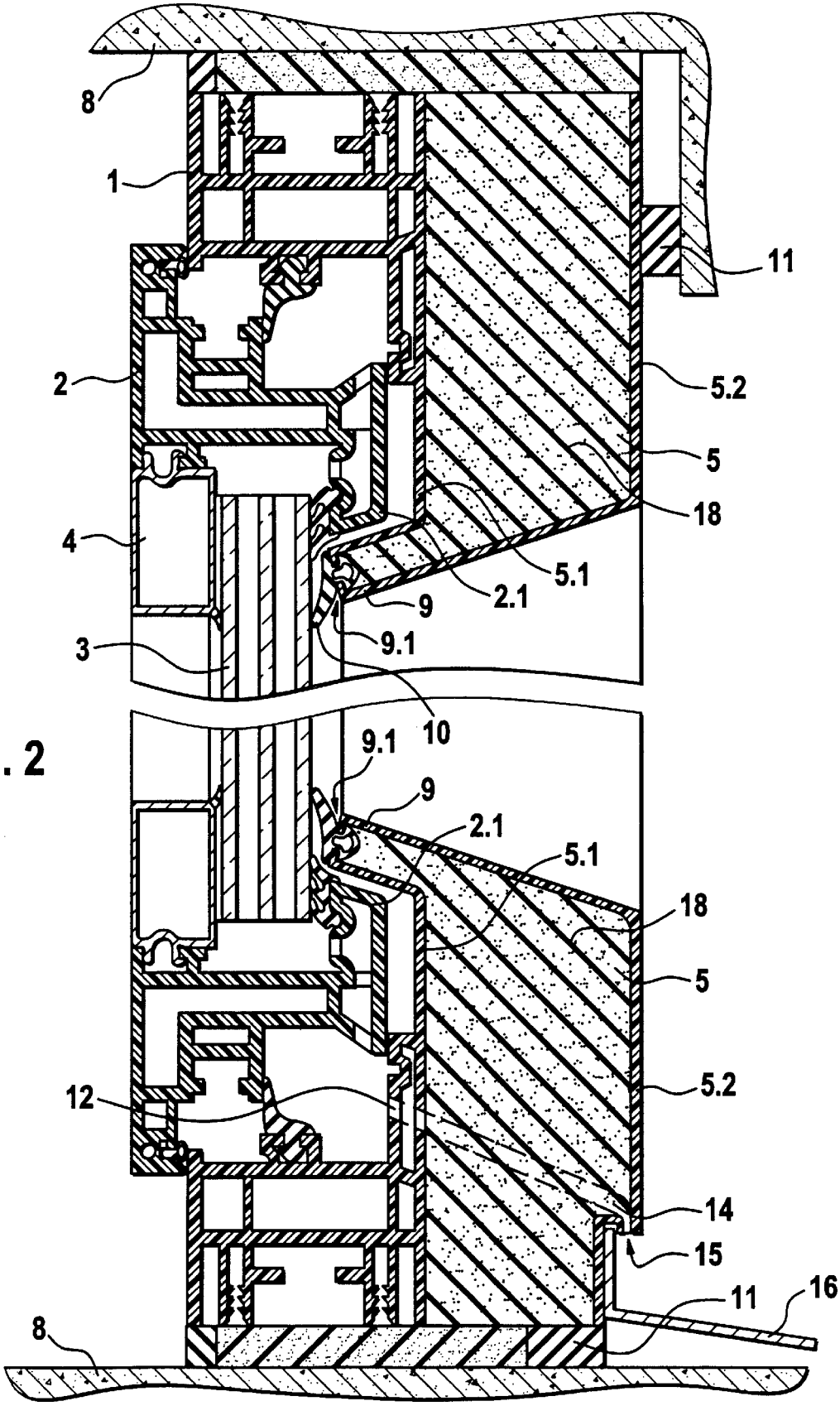
FIG. 2 is a vertical sectional view taken through window and sash frames of a plastic or metal window provided with an integral casing according to the invention.

The embodiment example in FIG. 2 shows a plastic or aluminum window in which identical parts are given the same numerical designations as in FIG. 1. In this case the casing 5 is integrated with the profile of the window frame 1, with the profile including the casing 5 being produced in one manufacturing process by means of extrusion.

The profile of casing 5 can be varied extensively in order to satisfy any visual and technical requirements. By designing the window with transoms and mullions to divide up the area of the window horizontally and vertically, the casing 5 can be supplemented with thin-walled, U-shaped elements having two gaskets making contact with the pane 3. The arrangement according to the invention is of course also suitable for improving the thermal insulation of fixed lites.

What is claimed is:

1. A thermally insulated window assembly, comprising:

(a) a sash frame encompassing a central region;

(b) a window pane of insulating glass disposed in and supported by said sash frame in said central region of said sash frame;

(c) a window frame encompassing a central cavity and surrounding and supporting said sash frame with said window pane therein in said central cavity of said window frame; and (d) a frame cladding providing thermal insulation for said sash and window frames, said frame cladding including (i) a twin-walled casing having an inner wall located outside both said central region of said sash frame and said central cavity of said window frame and adjacent to said window pane and said sash and window frames and an outer wall located remote therefrom such that said casing covers outsides of said sash and window frames, said casing also having an inner section disposed adjacent to said window pane and being attached to and bend from said inner and outer walls and extending beyond said inner and outer walls into both said central region of said sash frame and said central cavity of said window frame toward said window pane, said inner section having an inner end disposed adjacent to said window pane in both said central region of said sash frame and said central cavity of said window frame, (ii) a cavity in said casing formed between said inner and outer walls and said inner section of said casing, (iii) a thermal insulation material filling said cavity of said casing, and (iv) a permanently elastic gasket disposed in both said central region of said sash frame and said central cavity of said window frame and fitted to said inner end of said inner section of said casing and making contact with said window pane.

2. The assembly according to claim 1 wherein said inner wall of said casing is formed integral with said window frame.

3. The assembly according to claim 1 wherein said casing is formed as a separate component from said window frame and said assembly further comprises means for fastening said casing to said window frame.

4. The assembly according to claim 1 wherein said cavity of said casing has a width of between 20 and 100 mm.

5. The assembly according to claim 1 wherein said cavity of said casing is provided with drainage holes passing through said cavity.

6. The assembly according to claim 1 wherein said gasket and said inner end of said inner section of said casing have means for detachably fitting said gasket to said inner end of said inner section of said casing.

7. The assembly according to claim 1 wherein said frame cladding further includes spacers on said inner wall of said casing ensuring that a gap is provided between said casing and said window frame.

8. A frame cladding for thermally insulating a sash frame and a window frame of a window assembly wherein a window pane of insulating glass is disposed in a central region encompassed by the sash frame and is supported by the sash frame and the window frame surrounds and supports the sash frame with the window pane therein in a central cavity encompassed by the window frame, said frame cladding comprising:

(a) a twin-walled casing having an inner wall for location outside both said central region of said sash frame and said central cavity of baid window frame and adjacent to the window pane and the sash and window frames and an outer wall for location remote therefrom such that said casing can cover outsides of the sash and window frames, said casing also having an inner section for disposing adjacent to the window pane and being attached to and bend from said inner and outer walls for extending beyond said inner and outer walls into both said central region of said sash frame and said central cavity of said window frame toward the window pane, said inner section having an inner end for disposing adjacent to the window pane in both said central region of said sash frame and said central cavity of said window frame;

(b) a cavity in said casing formed between said inner and outer walls and said inner section of said casing;

(c) a thermal insulation material filling said cavity of said casing; and (d) a permanently elastic gasket disposed in both said a central region of said sash frame and said central cavity of said window frame and fitted to said inner end of said inner section of said casing for making contact with the window pane.

9. The frame cladding according to claim 8 wherein said cavity of said casing has a width of between 20 and 100 mm.

10. The frame cladding according to claim 8 wherein said cavity of said casing is provided with drainage holes passing through said cavity.

11. The frame cladding according to claim 8 wherein said gasket and said inner end of said inner section of said casing have means for detachably fitting said gasket to said inner end of said inner section of said casing.

12. The frame cladding according to claim 8 further comprising:

spacers on said inner wall of said casing for providing a gap between said casing and the window frame.

* * * * *